US008662056B2

(12) United States Patent
Fedor, III et al.

(10) Patent No.: US 8,662,056 B2
(45) Date of Patent: Mar. 4, 2014

(54) FUEL PRESSURE CONTROL SYSTEM AND METHOD HAVING A VARIABLE PULL-IN TIME INTERVAL BASED PRESSURE

(75) Inventors: William J. Fedor, III, Williamsville, NY (US); Charles A. Iannone, West Henrietta, NY (US); Sergio Quelhas, Ann Arbor, MI (US)

(73) Assignee: Delphi Technologies, Inc., Troy, MI (US)

( * ) Notice: Subject to any disclaimer, the term of this patent is extended or adjusted under 35 U.S.C. 154(b) by 560 days.

(21) Appl. No.: 12/981,613

(22) Filed: Dec. 30, 2010

(65) Prior Publication Data

US 2012/0167993 A1 Jul. 5, 2012

(51) Int. Cl.
*F02M 57/02* (2006.01)

(52) U.S. Cl.
USPC ..... 123/446; 417/298

(58) Field of Classification Search
USPC ..... 123/446, 447, 506; 417/298
See application file for complete search history.

(56) References Cited

U.S. PATENT DOCUMENTS

| | | | | | |
|---|---|---|---|---|---|
| 5,235,490 | A * | 8/1993 | Frank et al. | ..... | 361/154 |
| 6,061,224 | A * | 5/2000 | Allen | ..... | 361/154 |
| 6,076,508 | A * | 6/2000 | Nakano | ..... | 123/490 |
| 6,234,150 | B1 * | 5/2001 | Watanabe | ..... | 123/490 |
| 6,755,181 | B2 * | 6/2004 | Aubourg | ..... | 123/478 |
| 7,360,526 | B2 * | 4/2008 | Kemmer | ..... | 123/490 |
| 7,552,720 | B2 * | 6/2009 | Borg et al. | ..... | 123/508 |
| 7,559,313 | B2 * | 7/2009 | Tokuo et al. | ..... | 123/501 |
| 7,819,637 | B2 * | 10/2010 | Oda et al. | ..... | 417/298 |
| 7,979,194 | B2 * | 7/2011 | Wilhelm et al. | ..... | 701/104 |
| 8,011,351 | B2 * | 9/2011 | Casasso | ..... | 123/490 |
| 8,091,530 | B2 * | 1/2012 | Surnilla et al. | ..... | 123/446 |
| 8,245,693 | B2 * | 8/2012 | Surnilla et al. | ..... | 123/446 |

* cited by examiner

*Primary Examiner* — Thomas Moulis
(74) *Attorney, Agent, or Firm* — Lawrence D. Hazelton

(57) ABSTRACT

A system and method for controlling fuel pressure in a fuel delivery system. The system includes a fuel pump and an inlet control valve. The inlet control valve is operated to a closed state by an electrical signal applied to the inlet control valve. The electrical signal includes a pull-in portion of the electrical signal that is applied to the inlet control valve having a pull-in time interval that is varied based on the fuel pressure. By varying the pull-in time interval to control fuel pressure, electrical energy consumed and acoustic noise generated by the fuel delivery system are reduced.

8 Claims, 4 Drawing Sheets

FUEL PRESSURE CONTROL SYSTEM AND METHOD HAVING A VARIABLE PULL-IN TIME INTERVAL BASED PRESSURE

TECHNICAL FIELD OF INVENTION

The invention generally relates to a system and method for controlling fuel pressure in a fuel deliver system, and more particularly relates to varying a pull-in time interval of a pull-in portion of an electronic signal applied to an inlet control valve of the fuel delivery system based on a fuel pressure of the system.

BACKGROUND OF INVENTION

Some fuel deliver systems used on gasoline direct injected engines use a combination of a solenoid actuated inlet control valve metering fuel to a high pressure piston type pump to provide high pressure fuel to one or more fuel injectors. It is desirable to minimize electrical energy consumed to actuate the solenoid of the inlet control valve, and minimize acoustic noise generated by the same. It has been observed that reducing electrical energy consumption also reduces acoustic noise. It is known to use predetermined characteristics of an electric signal applied to such an inlet control valve reduce electrical energy use and acoustic noise generation. These predetermined characteristics are based on one or more representative inlet control valves. However, because of production variation, such predetermined characteristics may result in some pumps consuming more electrical energy and producing more acoustic noise than absolutely necessary. If the predetermined characteristics are changed to reduce this problem, there is a risk that some inlet control valves may not work properly and may lead to unstable pressure control.

SUMMARY OF THE INVENTION

In accordance with one embodiment of this invention, a system for controlling fuel pressure in a fuel delivery system is provided. The system includes a fuel pump and an inlet control valve. The fuel pump has an inlet configured to receive fuel from a fuel source and an outlet configured to output fuel characterized as being at a fuel pressure. The inlet control valve is interposed between the inlet and the fuel source. The inlet control valve is operable to an open state whereby the inlet is in fluid communication with the fuel source, and is operable to a closed state whereby fluid communication between the inlet and the fuel source is obstructed. The inlet control valve is operated to the closed state by an electrical signal applied to the inlet control valve. The electrical signal includes a pull-in portion of the electrical signal that is applied to the inlet control valve having a pull-in time interval. The pull-in time interval is varied based on the fuel pressure to reduce electrical energy consumed and reduce acoustic noise generated by the fuel delivery system.

In another embodiment of the present invention, a controller for controlling fuel pressure in a fuel deliver system is provided. The system includes a fuel pump having an inlet configured to receive fuel from a fuel source and an outlet configured to output fuel characterized as at a fuel pressure, and an inlet control valve interposed between the inlet and the fuel source. The inlet control valve is operable to an open state whereby the inlet is in fluid communication with the fuel source, and is operable to a closed state whereby fluid communication between the inlet and the fuel source is obstructed. The controller is configured to apply an electrical signal to the inlet control valve. The electrical signal includes a pull-in portion of the electrical signal that is applied to the inlet control valve. The pull-in portion is defined in part by a pull-in time interval. The controller is further configured to receive a pressure signal indicative of the fuel pressure, and vary the pull-in time interval based on the fuel pressure to reduce electrical energy consumed and reduce acoustic noise generated by the fuel delivery system.

In yet another embodiment of the present invention, a method of operating a system for controlling fuel pressure in a fuel deliver system is provided. The system includes a fuel pump having an inlet configured to receive fuel from a fuel source and an outlet configured to output fuel characterized as at a fuel pressure. The inlet control valve is interposed between the inlet and the fuel source. The inlet control valve is operable to an open state whereby the inlet is in fluid communication with the fuel source, and is operable to a closed state whereby fluid communication between the inlet and the fuel source is obstructed. The method includes the step of applying an electrical signal to the inlet control valve to urge the inlet control valve to the closed state. The step of applying an electrical signal includes applying a pull-in portion of the electrical signal for a pull-in time interval followed by applying a hold portion of the electrical signal. The method also includes the step of receiving a fuel pressure signal indicative of the fuel pressure. The method also includes the step of determining a subsequent electrical signal that includes determining a pull-in time interval of a subsequent pull-in portion based on the fuel pressure to reduce electrical energy consumed and reduce acoustic noise generated by the fuel delivery system.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION OF INVENTION

Figure 1:
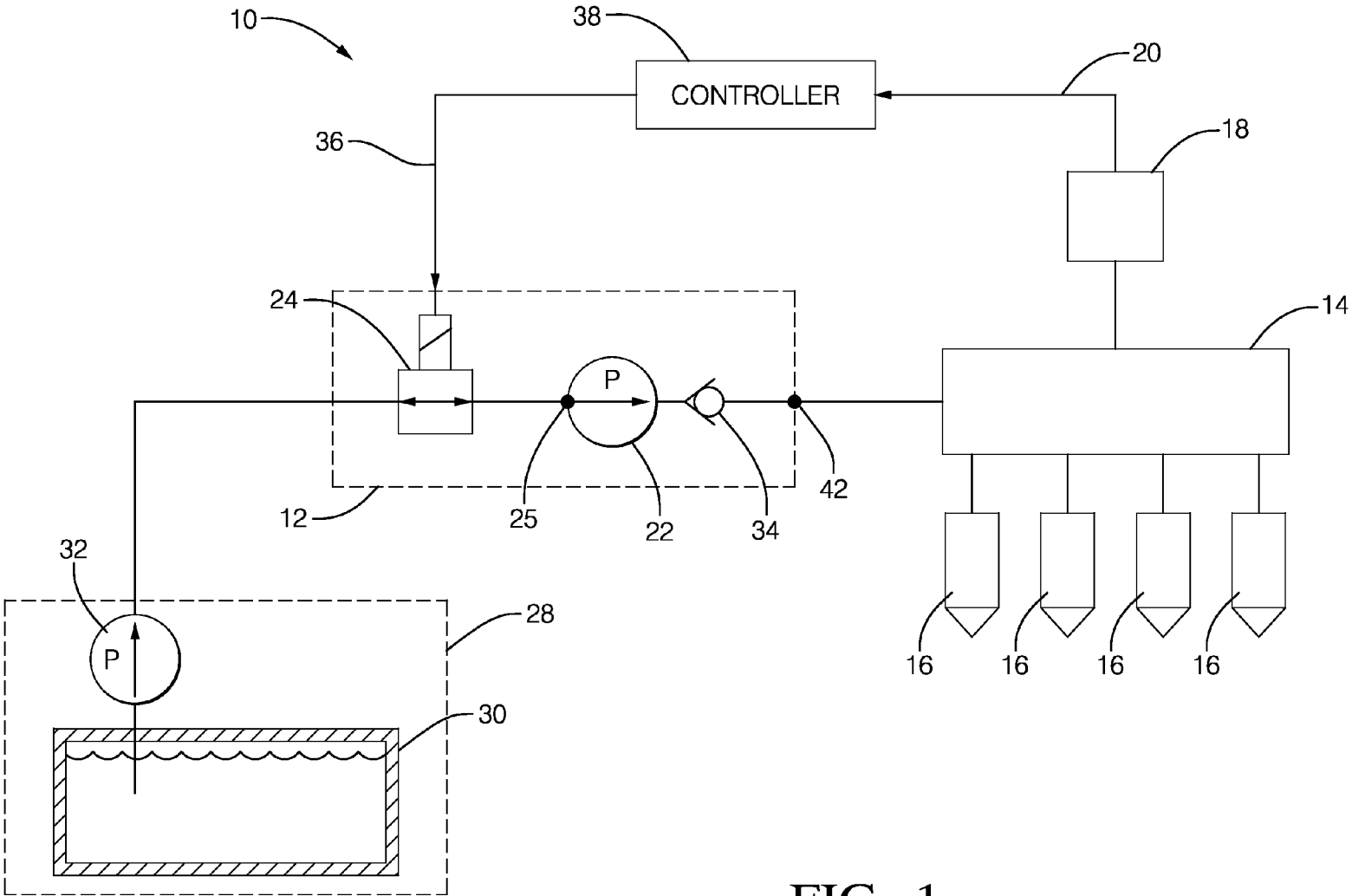
FIG. 1 is a diagram of a fuel pressure control system in accordance with one embodiment.

In accordance with an embodiment of a system for controlling fuel pressure in a fuel deliver system, FIG. 1 illustrates a fuel pressure control system 10. In general, the system 10 operates to control fuel pressure output from a high pressure fuel pump 12 by sensing fuel pressure at some location in the system 10, for example, fuel pressure within a fuel rail 14 feeding fuel to one or more fuel injectors 16. In this non-limiting example, fuel pressure is sensed by a pressure sensor 18 in fluidic communication with the fuel rail 14. In general, the pressure sensor is configured to output a pressure signal 20 indicative of the fuel pressure in the fuel rail 14.

The high pressure fuel pump assembly 12 may include a fuel pump 22 and an inlet control valve 24. The fuel pump 22 is generally configured with an inlet 25 to receive fuel from a fuel source 28. In this non-limiting example, the fuel source 28 includes a fuel tank 30 and a low pressure pump 32. Alternatively the fuel tank 30 could be arranged so gravity urges fuel to flow from the fuel tank 30 toward the inlet 25, or the fuel tank could be pressurized to urge fuel out of the fuel tank 30. The fuel pump 22 or the assembly 12 may also include an outlet 42 illustrated here as including an outlet check valve 34. In this non-limiting example, fuel at the outlet 42 is generally considered to have the same fuel pressure as the fuel in the fuel rail 14, however it is recognized that restriction in the fluid path between the outlet 42 and the fuel rail 14 may induce a pressure difference.

The inlet control valve 24 is illustrated as being interposed between the inlet 25 and the fuel source 28. The illustration suggests that inlet control valve 24 is part of the assembly 12, but it could be a separate part at a location remote from the fuel pump 22. In general, the inlet control valve 24 is operable to an open state whereby the inlet 25 is in fluid communication with the fuel source 28, and operable to a closed state whereby fluid communication between the inlet 25 and the fuel source 28 is obstructed. In one embodiment the inlet control valve is operated to the closed state by applying an electrical signal 36 to the inlet control valve 24 from a controller 38 receiving the pressure signal 20. United States Patent Publication 2010/0237266 entitled METHOD FOR CONTROLLING A SOLENOID VALVE OF A QUANTITY CONTROLLER IN AN INTERNAL COMBUSTION ENGINE by Haaf et al., published Sep. 23, 2010, provides a description of how a quantity control valve, comparable to Applicants' inlet control valve 24, and a piston type high-pressure pump, comparable to Applicants' fuel pump 22, are cooperatively operated to control fuel pressure, the entire contents of which are hereby incorporated by reference herein. In general, the operation of the inlet control valve 24 and the cyclical operation of the fuel pump 22 are temporally synchronized, and the timing of closing the inlet control valve relative to the cyclical operation of the fuel pump 22 can be used to control fuel pressure at the outlet 42.

Figure 2:
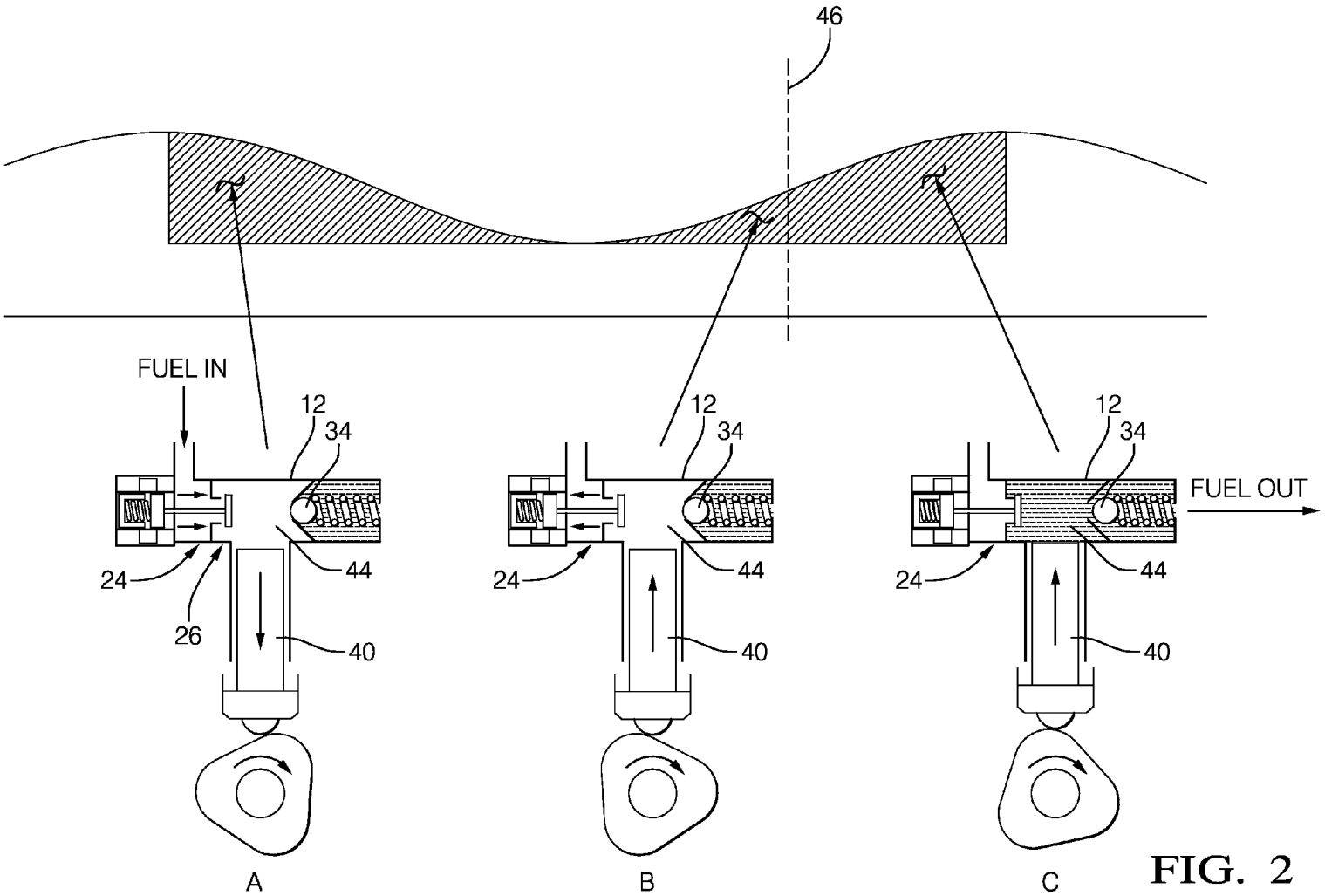
FIG. 2 is a combination of a cut away view of a fuel pump assembly at various stages of operation and corresponding graphical description of a piston position of the fuel pump assembly in accordance with one embodiment.

FIG. 2 illustrates an example of operation of the inlet control valve 24 and a piston 40 within the assembly 12. The sinusoidal curve illustrates the cyclical motion of the piston 40, illustrated in this example as arising from following a cam profile. In the leftmost illustration of the assembly 12 labeled A, the inlet control valve 24 is illustrated in the open state and the piston 40 is moving downward. With the inlet control valve 24 in the open state and the piston 40 moving downward, fuel is drawn from the fuel source 28, through the inlet control valve 24, and into a piston chamber 44. The center illustration labeled B shows the piston 40 beginning to move upward. However, since the inlet control valve 24 is in the open state, fuel may pass back through the inlet control valve 24 and so fuel in the piston chamber 44 is generally not compressed. The vertical dashed line 46 in the graph indicates the moment that the inlet control valve 24 transitions to the closed state, and so as the piston 40 continues to move upward, fuel in the piston chamber 44 is compressed. The rightmost illustration labeled C illustrates that the fuel pressure in the piston chamber 44 exceeds the fuel pressure at the outlet 42 by an amount sufficient to overcome the spring force of the check valve 34, and so fuel is pumped out of the assembly 12. The amount of fuel pumped by each cycle of the assembly 12 influences the fuel pressure in the fuel rail 14. For example, assume that the amount of fuel drawn away from the fuel rail 14 by the injectors 16 is equal to the amount pumped if the inlet control valve 24 closes at the time illustrate in FIG. 2 by the dashed line 46. If the inlet control valve 24 closes earlier when the piston 40 is traveling upward, the dashed line 46 moves left and more fuel will be present in the piston chamber 44, and so the fuel rail receives more fuel. If the fuel rail 14 is a constrained body, meaning that the pressure increases as the volume of fuel contained within the fuel rail 14 increases, then the fuel pressure may be increased if fuel is drawn away from the fuel rail 14 by the injectors 16 is less than the amount pumped. Similarly, if the inlet control valve is closed later so the dashed line is moved to the right, then less fuel is pumped and so pressure in the fuel rail is decreased assuming that fuel is drawn away from the fuel rail 14 by the injectors 16 is greater than the amount pumped.

In general, fuel pump assemblies such as the assembly 12 described herein have inlet control valves that are normally open, that is they are in the open state if no particular electric signal is being applied. The inlet control valve 24 may be held in the open state by a spring. Alternatively, the inlet control valve 24 may be configured so it transitions to the open state when the piston 40 draws fuel through the inlet control valve 24, and remains in the open state even if fuel flows in the opposite direction. Operating the inlet control valve 24 to the closed state generally requires that the electronic signal 36 be sufficient to activate a solenoid coupled to a valve portion to transition the inlet control valve 24 to the closed state. Applicants and others have observed that the characteristics or profile of the electronic signal 36 used to close the inlet control valve can influence the amount of electrical energy consumed each time the inlet control valve 24 is closed, and can influence the amount of acoustic noise is generated by the inlet control valve 24.

While not subscribing to any particular theory and based on observation, it is thought that the amount of acoustic noise is related to the speed of a solenoid, or force of impact imparted by the solenoid when the solenoid impacts a mechanical stop within the inlet control valve 24. It has been observed that reducing the amount of electric energy consumed when closing the inlet control valve 24 reduces the amount of acoustic noise generated by the inlet control valve 24. Haaf et al. (US2010/0237266) suggests that limiting current delivered to an inlet control valve to a relatively constant value reduces acoustic noise. Haaf et al. limits the current by pulse width modulating a switch that alternatingly connects and disconnects a voltage to a quantity controlling valve similar to Applicants' inlet control valve 24. However, such an approach increases the time it takes to close the quantity controlling valve which may become a problem at high engine speeds.

In contrast, Applicants have discovered that by applying a controlled time interval of a higher current or higher voltage to the inlet control valve 24, both electrical energy consumption and acoustic noise can be reduced without excessive delays of closing the inlet control valve 24. As such, the electrical signal 36 includes a pull-in portion 48 of the electrical signal 36 that is applied to the inlet control valve 24 characterized as having a pull-in time interval 50 that is varied based on the fuel pressure indicated by the pressure sensor 18. The pull-in time interval 50 is varied to reduce electrical energy consumed and reduce acoustic noise generated by the fuel delivery system or the system 10 when operating the inlet control valve 24. If fuel pressure is too low, then the inlet control valve 24 is closed sooner so more fuel is output by the assembly 12. If fuel pressure is too high, then the inlet control valve 24 is closed later so more fuel is back washed through the inlet control valve and less fuel is output by the assembly 12.

In some inlet control valves it may be desirable to follow the pull-in portion 48 with a hold portion 52 following the pull-in portion 48. For example, the hold portion 52 may be a voltage or current that is reduced relative to a voltage or current used in the pull-in portion 48, but is sufficient to prevent valve bounce-off of the inlet control valve 24 when the solenoid impacts the mechanical stop, or prevent valve bounce-off caused by ringing or oscillations of fuel pressure within or outside of the assembly 12.

It has been observed that the inlet control valve 24 can be reliably closed by ending the pull-in portion 48 prior to the solenoid impacting the mechanical stop. While not subscribing to any particularly theory, it is believed that once the solenoid is moving with enough inertia, the pull-in portion 48 can be ended and the solenoid coasts to the mechanical stop to transition the inlet control valve 24 to the closed state. It follows then that if a hold portion 52 is required or desired, then the pull-in time interval 50 is such that the hold portion 52 begins before the inlet control valve 24 has transitioned to the closed state.

In one embodiment, the pull-in portion 48 may include applying a voltage to the inlet control valve 24 for the pull-in time interval 50. The voltage may be a regulated voltage, or raw battery voltage from a vehicle electrical system, or a boosted voltage that is generally greater than the raw battery voltage.

Figure 3:
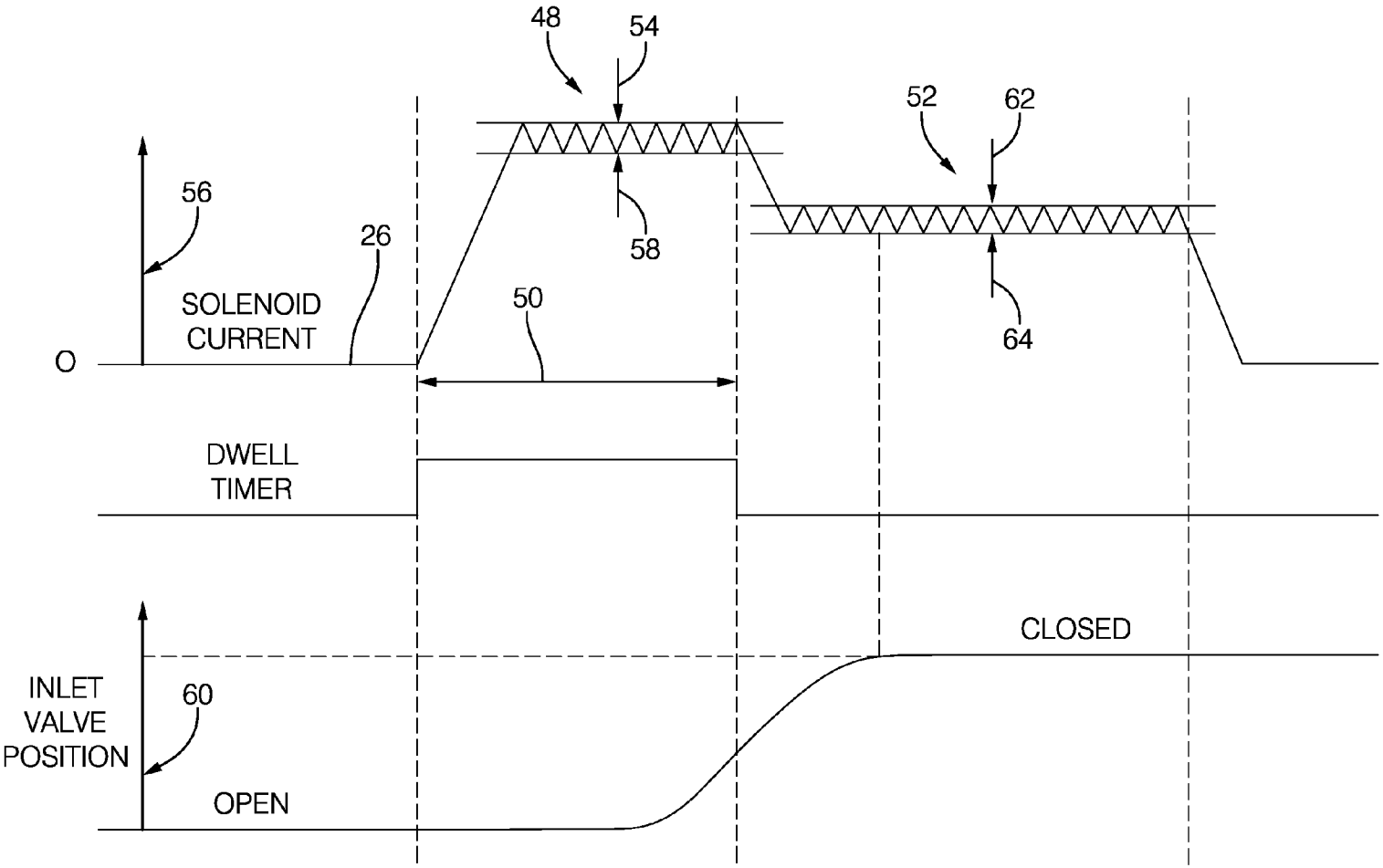
FIG. 3 is a graphical timing diagram of signals in a fuel pressure control system in accordance with one embodiment.

FIG. 3 illustrates a non-limiting example of the electronic signal 26 that may be applied to the inlet control valve 24. In this example, a voltage is applied until a solenoid current 56 equals or exceeds a maximum pull-in current 54. In accordance with this example, the voltage is disconnected until the solenoid current 56 decays to a minimum pull-in current 58 whereupon the voltage is reconnected and the solenoid current 56 begins to rise. This method of current control is sometimes referred to as a bang-bang current control method. Alternately, the current could be controlled at some steady current level by a known analog control circuit, or the voltage could be momentarily disconnected for a fixed period of time following the solenoid current 56 reaching the maximum pull-in current 54 and then reconnected following the fixed period of time. By these examples, the pull-in portion 48 may be characterized as being current limited to the maximum pull-in current 54.

FIG. 3 further illustrates a graph of an inlet valve position 60 temporally corresponding to the electronic signal 26. The graph illustrates that the pull-in portion 48 of the electronic signal 26 is completed before the inlet valve position 60 transitions from OPEN to CLOSED. As described above, the end of the pull-in portion 48 may be followed by no voltage or current being applied to the inlet control valve, or as illustrated here, the end of the pull-in portion 48 may be followed by a hold portion 52. Similar to the description of the pull-in portion 48 above, the hold portion 52 may be characterized as being current limited to a maximum hold current 62 that is less than the maximum pull-in current 54. Also similar to the pull-in portion 48, the hold portion 52 may control the solenoid current 56 using a bang-bang control method to keep the solenoid current 56 between the maximum hold current 62 and a minimum hold current 64 during the hold portion 52. After a period of time, possibly dependent on the position of the piston 40 (FIG. 2), the hold portion 52 may end and the voltage applied to the inlet control valve may return to zero as illustrated.

Referring to FIG. 1, the system 10 may include a controller 38 for controlling fuel pressure. The controller 38 may be configured to apply the electrical signal 26 to the inlet control valve 24, receive the pressure signal 20 indicative of the fuel pressure, and vary the pull-in time interval 50 based on the fuel pressure. Varying the pull-in time interval has been observed to be an effective way to reduce electrical energy consumed and reduce acoustic noise generated by the fuel delivery system or system 10. The controller 38 may include a processor (not shown) such as a microprocessor or other control circuitry as should be evident to those in the art. The controller 38 may include memory (not shown), including non-volatile memory, such as electrically erasable programmable read-only memory (EEPROM) for storing one or more routines, thresholds and captured data. The one or more routines may be executed by the processor to perform steps for determining if signals received by the controller 38 are suitable for determining the pull-in time interval 50, or other aspects of the electronic signal 26 as described herein.

Figure 4:
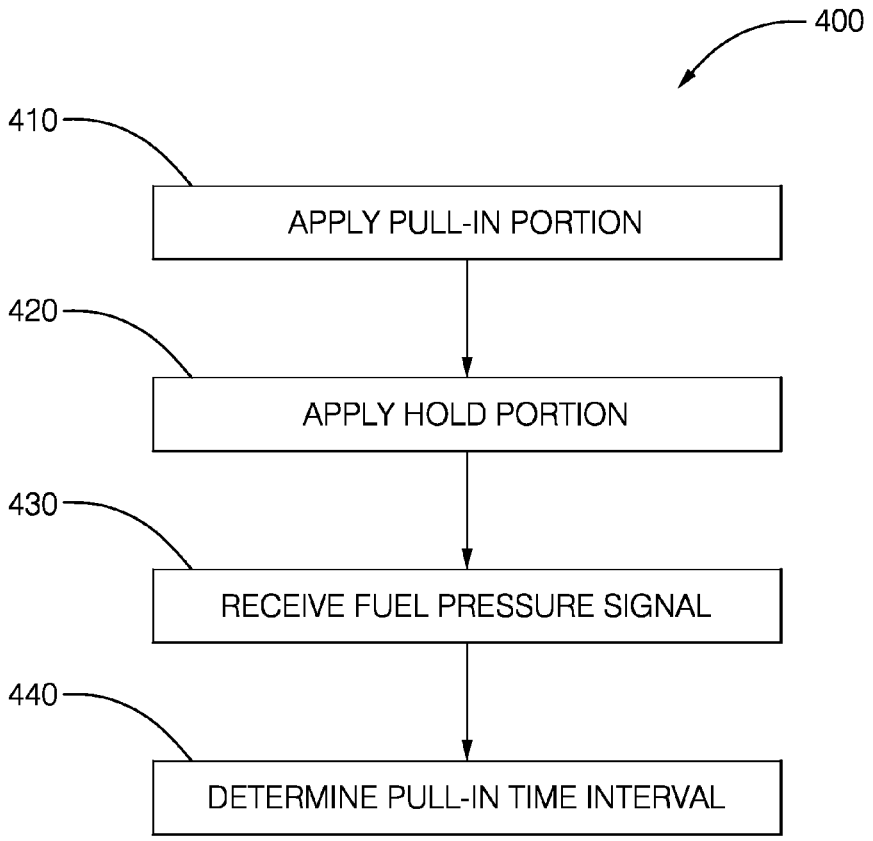
FIG. 4 is a flowchart of a method for operating a fuel pressure control system.

FIG. 4 illustrates a method 400 of operating a system 10 for controlling fuel pressure in a fuel deliver system.

Step 410, APPLY PULL-IN PORTION, may be part of applying an electrical signal 26 to the inlet control valve 24 to urge the inlet control valve 24 to a closed state, see CLOSED in FIG. 3. The pull-in portion 48 may be characterized as lasting for a pull-in time interval 50.

Optional step 420, APPLY HOLD PORTION, may be an optional part of applying an electrical signal 26 to the inlet control valve 24 to continue to urge the inlet control valve 24 to a closed state and/or hold the inlet control valve 24 in the closed state following step 410.

Step 430, RECEIVE FUEL PRESSURE SIGNAL, may include receiving a pressure signal 20 from a pressure sensor 18 coupled to a fuel rail 14. The pressure signal 20 may be indicative of the fuel pressure within the fuel rail 14.

Step 440, DETERMINE PULL-IN TIME INTERVAL, may include determining a subsequent electrical signal 26 that includes determining a pull-in time interval 50 of a subsequent pull-in portion 48 based on the fuel pressure to reduce electrical energy consumed and reduce acoustic noise generated by the system 10. Determining a pull-in time interval 50 for the subsequent pull-in portion 48 may include decreasing the pull-in time interval 50 if the fuel pressure is higher than a target fuel pressure and/or increasing the pull-in time interval 50 if the fuel pressure is lower than the target fuel pressure. The target fuel pressure is determined based on the fuel pressure requirements of the fuel injectors 16.

In one embodiment, the pull-in time interval 50 may be selected so the subsequent pull-in portion 48 ends before the inlet control valve 24 is in the closed state. In another embodiment, the subsequent pull-in portion 48 may be characterized as being current limited to a maximum pull-in current 54. In yet another embodiment the hold portion 52 may be characterized as being current limited to a maximum hold current 62 less than the maximum pull-in current 54.

Accordingly, a fuel pressure control system 10, a controller 38 in the system 10, and a method 400 of controlling the system 10 is provided. An aspect of controlling fuel pressure in a way that minimizes electrical energy consumption and acoustic noise creation by an inlet control valve 24 is controlling a pull-in time interval 50 of a pull-in portion 48 of an electric signal 26 applied to the inlet control valve 24. It has been observed that by varying the pull-in time interval 50 in accordance with fuel pressure, electrical energy consumption and acoustic noise are lower than other methods of controlling fuel pressure, in particular lower than a method that seeks to reduce noise by limiting current to some substantially constant level throughout the time the inlet control valve transitions from an open position to a closed position.

While this invention has been described in terms of the preferred embodiments thereof, it is not intended to be so limited, but rather only to the extent set forth in the claims that follow.

We claim:

1. A system for controlling fuel pressure in a fuel delivery system, said system comprising:

a fuel pump having an inlet configured to receive fuel from a fuel source and an outlet configured to output fuel characterized as at a fuel pressure; and an inlet control valve interposed between the inlet and the fuel source, said inlet control valve operable to an open state whereby the inlet is in fluid communication with the fuel source, and operable to a closed state whereby fluid communication between the inlet and the fuel source is obstructed, wherein said inlet control valve is operated to the closed state by an electrical signal applied to the inlet control valve, wherein said electrical signal includes a pull-in portion of the electrical signal that is applied to the inlet control valve having a pull-in time interval that is varied based on the fuel pressure to reduce electrical energy consumed and reduce acoustic noise generated by the fuel delivery system, wherein said electrical signal further includes a hold portion after the pull-in portion, wherein said pull-in time interval is such that the hold portion begins before the inlet control valve is in the closed state.

2. The system in accordance with claim 1, wherein said pull-in portion is characterized as a voltage applied to the inlet control valve.

3. The system in accordance with claim 1, wherein said pull-in portion is characterized as being current limited to a maximum pull-in current.

4. The system in accordance with claim 3, wherein said hold portion is characterized as being current limited to a maximum hold current less than the maximum pull-in current.

5. A controller for controlling fuel pressure in a fuel deliver system, said system comprising a fuel pump having an inlet configured to receive fuel from a fuel source and an outlet configured to output fuel characterized as at a fuel pressure, and an inlet control valve interposed between the inlet and the fuel source, said inlet control valve operable to an open state whereby the inlet is in fluid communication with the fuel source, and operable to a closed state whereby fluid communication between the inlet and the fuel source is obstructed, wherein said controller is configured to apply an electrical signal to the inlet control valve, wherein said electrical signal includes a pull-in portion of the electrical signal that is applied to the inlet control valve having a pull-in time interval, wherein said controller is further configured to receive a pressure signal indicative of the fuel pressure, and wherein said controller is further configured vary the pull-in time interval based on the fuel pressure to reduce electrical energy consumed and reduce acoustic noise generated by the fuel delivery system, wherein said electrical signal further includes a hold portion after the pull-in portion, wherein said pull-in time interval is such that the hold portion begins before the inlet control valve is in the closed state.

6. A method of operating a system for controlling fuel pressure in a fuel deliver system, said system comprising a fuel pump having an inlet configured to receive fuel from a fuel source and an outlet configured to output fuel characterized as at a fuel pressure, and an inlet control valve interposed between the inlet and the fuel source, said inlet control valve operable to an open state whereby the inlet is in fluid communication with the fuel source, and operable to a closed state whereby fluid communication between the inlet and the fuel source is obstructed, said method comprising the steps of:

applying an electrical signal to the inlet control valve to urge the inlet control valve to the closed state, wherein applying an electrical signal includes applying a pull-in portion of the electrical signal for a pull-in time interval followed by applying a hold portion of the electrical signal;

receiving a fuel pressure signal indicative of the fuel pressure; and determining a subsequent electrical signal that includes determining a pull-in time interval of a subsequent pull-in portion based on the fuel pressure to reduce electrical energy consumed and reduce acoustic noise generated by the fuel delivery system, wherein said pull-in time interval is such that the hold portion begins before the inlet control valve is in the closed state.

7. The method in accordance with claim 6, wherein said subsequent pull-in portion is characterized as being current limited to a maximum pull-in current.

8. The method in accordance with claim 7, wherein said hold portion is characterized as being current limited to a maximum hold current less than the maximum pull-in current.

* * * * *